US005862808A

United States Patent [19]

Albarello

[11] Patent Number: 5,862,808

[45] Date of Patent: Jan. 26, 1999

[54] CIGAR PUNCH

[75] Inventor: Valerio Albarello, Meriden, Conn.

[73] Assignee: Cigar Savor Enterprises LLC, Woodbridge, Conn.

[21] Appl. No.: 918,962

[22] Filed: Aug. 26, 1997

[51] Int. Cl.[6] ..... A24F 13/24

[52] U.S. Cl. ..... 131/255; 131/248; 131/250

[58] Field of Search ..... 131/255, 248, 131/250, 252, 253

[56] References Cited

U.S. PATENT DOCUMENTS

| | | | |
|---|---|---|---|
| 282,764 | 8/1883 | Peavey | 131/255 |
| 308,906 | 12/1884 | Larsen et al. | 131/255 |
| 703,162 | 6/1902 | Todd, Jr. | 131/255 |
| 1,734,620 | 11/1929 | Giacopini | 131/255 |
| 2,832,354 | 4/1958 | Miller | 131/254 |
| 4,711,254 | 12/1987 | Fleisher et al. | 131/189 |
| 5,535,763 | 7/1996 | Conte | 131/255 |

*Primary Examiner*—John G. Weiss
*Assistant Examiner*—Charles W. Anderson
*Attorney, Agent, or Firm*—DeLio & Peterson, LLC

[57] ABSTRACT

An apparatus for cutting a plug from the end of a cigar comprises a housing having a hollow body portion with opposite first and second ends. The first end of the hollow body portion has a cutting edge for cutting a portion of a cigar wrapper at the end of a cigar prior to smoking. A spring-biased plunger is movable within the hollow body portion first end along a longitudinal axis thereof toward and away from the cutting edge. An elongated piercing member is attached to, and movable with, the plunger. A handle is accessible from the exterior of the housing for moving the plunger within the hollow body portion first end. The cutting edge is adaptable to cut a portion of a cigar wrapper at the end of a cigar to create a plug of the cut portion of the cigar, which plug remains at least in part within the hollow body portion first end, and the handle is operable to move the plunger toward the cutting edge to eject the plug from the housing.

13 Claims, 1 Drawing Sheet

CIGAR PUNCH

BACKGROUND OF THE INVENTION

1. Field of the Invention

The present invention relates to an apparatus for piercing and cutting a plug from the end of a cigar.

2. Description of Related Art

Devices for piercing and cutting the ends of cigars have been known in the prior art. Such devices are used to pierce the cigar wrapper at the closed end of the cigar and remove a portion thereof to provide an opening for smoke to enter the mouth of the cigar smoker. Examples of cigar piercing and cutting are found in U.S. Pat. Nos. 5,525,763, 4,711,254, 2,832,354, 1,734,620, 703,162, 308,906 and 282,764. While these devices have been generally useful, they have not been able to simply and efficiently deal with the removal of the plug created by a tubular cutter. For example, the '763 patent requires one to eject the plug cut from the cigar using two hands, one grasping the end of the device and the other pushing the collar to eject the plug. Others, such as the '620 patent have a mechanism which is overly complex. Also, both of these devices cannot simultaneously pierce and cut a plug from the cigar end. There has been a long-felt need to provide a device which overcomes these problems.

Bearing in mind the problems and deficiencies of the prior art, it is therefore an object of the present invention to provide a device for piercing and cutting a cigar which simply and efficiently deals with the problem of removal of the plug created by cutting the cigar end.

It is another object of the present invention to provide a device for piercing and cutting a cigar which may be used with one hand.

A further object of the invention is to provide a device for piercing and cutting a cigar which has a relatively simple structure for manufacturing and cost efficiencies.

It is yet another object of the present invention to provide a device for piercing and cutting a cigar which may both cut the plug and pierce the cigar at the same time.

Still other objects and advantages of the invention will in part be obvious and will in part be apparent from the specification.

SUMMARY OF THE INVENTION

The above and other objects, which will be apparent to those skilled in the art, are achieved in the present invention which provides an apparatus for cutting a plug from the end of a cigar comprising a housing having a hollow body portion with opposite first and second ends. The first end of the hollow body portion has a cutting edge for cutting a portion of a cigar wrapper at the end of a cigar prior to smoking. A plunger is movable within the hollow body portion first end along a longitudinal axis thereof toward and away from the cutting edge. A handle is accessible from the exterior of the housing for moving the plunger within the hollow body portion first end. The cutting edge is adaptable to cut a portion of a cigar wrapper at the end of a cigar to create a plug of the cut portion of the cigar, which plug remains at least in part within the hollow body portion first end, and the handle is operable to move the plunger toward the cutting edge to eject the plug from the housing.

Preferably, the device further includes an elongated member longitudinally aligned within the hollow body and extending from the hollow body first end for piercing a hole in the cigar wrapper at the end of the cigar, which elongated piercing member is attached to, and movable with, the plunger. The plunger may be biased within the hollow body portion away from the first end by a spring. The handle may extend from the second end of the hollow body portion and include a shaft between the handle and the plunger within the hollow body portion, wherein the handle is operable by pushing the handle toward the first end to eject the plug.

In another aspect, the present invention provides a method of cutting a plug from the end of a cigar. First, there is provided a device comprising a housing having a hollow body portion with opposite first and second ends, the first end of the hollow body portion having a cutting edge for cutting a portion of a cigar wrapper at the end of a cigar prior to smoking; and a plunger movable within the hollow body portion first end along a longitudinal axis thereof toward and away from the cutting edge. The method then includes the steps of positioning the device such that the cutting edge is adjacent to an end portion of a cigar having a wrapper thereon; moving the cutting edge toward the cigar to cut the wrapper and create a plug of the cut portion of the cigar, which plug remains at least in part within the hollow body portion first end; and moving the plunger toward the cutting edge to eject the plug from the housing.

Preferably, the device includes an elongated member longitudinally aligned within the hollow body and extending from the hollow body first end for piercing a hole in the cigar wrapper at the end of the cigar, and the method further includes the step of piercing a hole in the end of the cigar. The elongated piercing member may be attached to, and movable with, the plunger, wherein the piercing is simultaneous with the cutting. The plunger may be biased within the hollow body portion away from the first end, and the method may include the step of moving the plunger away from the first end after ejecting the plug. A handle may be provided accessible from the exterior of the housing for moving the plunger within the hollow body portion first end, the handle extending from the second end of the hollow body portion, and the method may include the step of pushing the handle toward the first end to eject the plug.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENTS(S)

Figure 1:
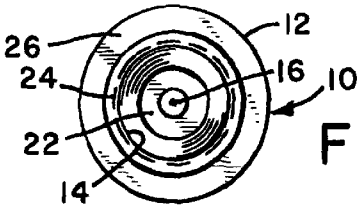
FIG. 1 is an end elevational view of a preferred embodiment of the cigar cutter of the present invention.

In describing the preferred embodiment of the present invention, reference will be made herein to FIGS. 1–4 of the drawings in which like numerals refer to like features of the invention. Features of the invention are not necessarily shown to scale in the drawings.

Figure 2:
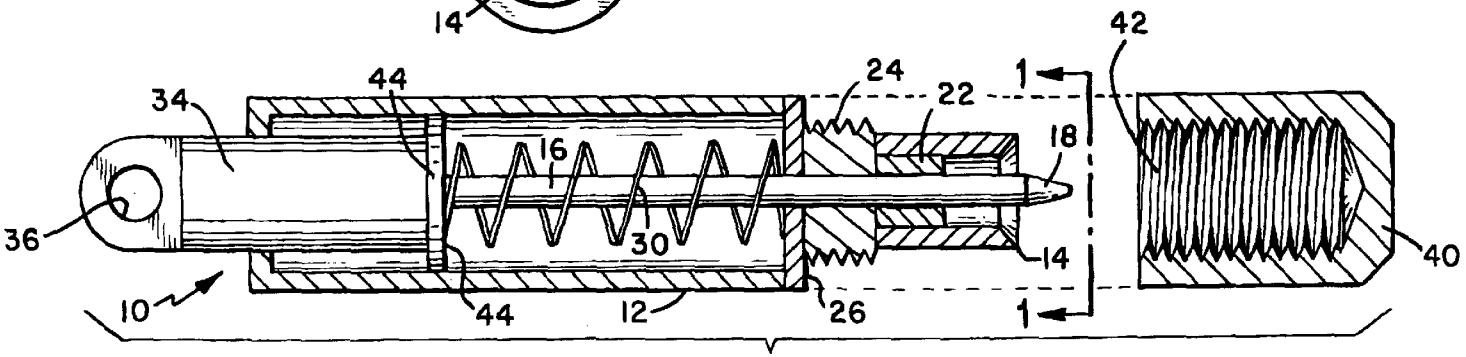
FIG. 2 is a side elevational view of the preferred embodiment of the present invention depicted in FIG. 1.

The preferred cigar punch or cutter of the present invention is depicted in FIGS. 1 and 2 wherein cigar cutter 10 has an elongated hollow body 12 such as drawn stainless steel in the form of a cylinder. At a first end thereof, there is mounted on collar 24 a cylindrical cutter 14 having a sharp, beveled edge for cutting through the wrapper of a cigar. Extending within hollow body 12 and out from the first end and cutter 14 is an elongated member or shaft 16 with a pointed end 18 for piercing the cigar wrapper. Shaft 16 is slideably mounted within housing 12 and is attached at an end opposite point 18 to handle 34, which extends longitudinally outward from the second end of housing 12 opposite the first end.

Collar 24 is attached to end cap 26 on body 12, and both the collar and end cap have central openings therein for passage of shaft 16. Annular cutter 14 may be removably secured to collar 24 by any known means in the art, for example, by a threads or a locking pin. Collar 24 is threaded on its exterior and also receives end cap 40 having comparable threads 42 to mate with housing 12 and completely cover cutting edge 14 and shaft point 18 for safety purposes.

A spring 30 is provided within housing 12 which bears at one end against housing end cap 26 and at the other end against handle 34 to bias the handle 34 and consequently shaft 16 toward the housing second end and away from the housing first end containing the cutter 14. Stops 44 are provided on the periphery of handle 34 to prevent handle 34 from being pushed out of the second end of housing 12.

Mounted moveably within cutter 14, and rigidly attached to shaft 16, there is provided an annular plunger 22 which is slideable within the cylindrical cutter body toward and away from the cutter edge 14 by movement of the handle 34 and shaft 16. An opening 36 is provided in handle 34 for securing to a key ring or the like. The function of plunger 22 is to remove a plug cut from a cigar end by cutter 14 and eject the plug from the device 10.

Figure 4:
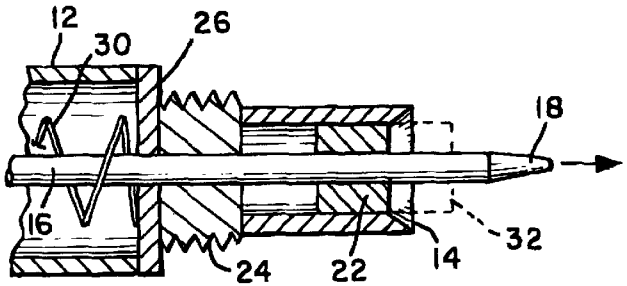
FIG. 4 is an enlarged view of a portion of the cigar cutter of FIG. 1 after cutting a plug from the end of a cigar and ejecting the plug.
Figure 3:
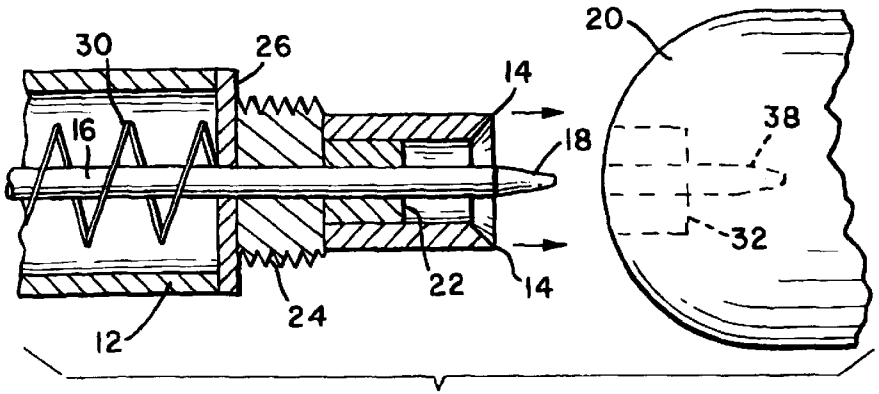
FIG. 3 is an enlarged view of a portion of the cigar cutter of FIG. 1 prior to cutting a plug from the end of a cigar.

Operation of the cutter of the present invention is shown in a preferred embodiment in FIGS. 3 and 4. Device 10 is moved by the user by grasping housing 12 and pushing shaft pointed end 18 and cutter edge 14 toward and into the wrapper at the end of a cigar 20. Upon movement of the cutter 14 and shaft point 18 into the cigar, there is created a cut plug 32 conforming to the cylindrical shape of the cutter cylindrical body 14, and a hole 38 which conforms to shaft 16 pointed end 18. After removal of the plug by pulling the device 10 away from the cigar, there are created openings in the cigar end which facilitate passage of cigar smoke to the user's mouth after the cigar is lit. It may be necessary to rotate the device in order to more easily remove plug 32 from the end of cigar 20. If an easier draw of the cigar is desired, the cigar may be re-pierced with pointed end 18 to enlarge the hole 38.

As shown in FIG. 4, to eject plug 32, the user then grasps the body portion with his or her hand and, with a thumb or finger of the same hand, pushes the handle so as to slide shaft 16 and attached plunger 22 forward toward the first end of the device, which movement then slides plug 32 out of cylindrical cutter 14. The plug 32 then either falls off shaft 16, or may be removed by the user's fingers if it is stuck on the shaft.

After ejection of the plug 32, the user then releases the handle and spring 30 pushes shaft 16 so as to withdraw the plunger back within cylindrical cutter 14 away from the first end of the device.

Accordingly, the present invention provide a device for piercing and cutting a cigar which simply and efficiently deals with the problem of removal of the plug created by cutting the cigar end, and which may be used with one hand. Further, the device has a relatively simple structure for manufacturing and cost efficiencies, and may both cut the plug and pierce the cigar at the same time.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. An apparatus for piercing and cutting a plug from the end of a cigar comprising;

a housing having a hollow body portion with opposite first and second ends, the first end of said hollow body portion having a cutting edge for cutting a portion of a cigar wrapper at the end of a cigar prior to smoking;

an elongated, solid shaft longitudinally aligned within said hollow body, said shaft having a pointed end extending from said hollow body first end for piercing a hole in said cigar wrapper at the end of said cigar;

a plunger attached to said shaft and movable within said hollow body portion first end along longitudinal axis thereof toward and away from said cutting edge; and a handle accessible from the exterior of said housing for moving said plunger within said hollow body portion first end, wherein, in a single operation, said pointed end is adaptable to the pierce a hole in the end of a cigar and said cutting edge is adaptable to cut a portion of a cigar wrapper at the end of said cigar to create a plug of the cut portion of the cigar, which plug remains at least in part within said hollow body portion first end, and wherein said handle is operable to move said shaft and said plunger toward said cutting edge to eject said plug from said housing.

2. The apparatus of claim 1 wherein said plunger is biased within said hollow body portion a way from said first end.

3. The apparatus if claim 1 further including a spring in said housing for biasing said plunger within said hollow body portion away from said first end.

4. The apparatus of claim 1 wherein said handle extends from the second end of said hollow body portion, and wherein said handle is operable by pushing said handle toward said first end to eject said plug.

5. The apparatus of claim 1 wherein said handle extends from the second end of said hollow body portion and further including a shaft between said handle and said plunger within said hollow body portion, whereby said handle is operable by pushing said handle toward said first end to eject said plug.

6. An apparatus for piercing and cutting a plug from the end of a cigar comprising;

a housing having a hollow body portion with opposite first and second ends, the first end of said hollow body portion having a cutting edge for cutting a portion of a cigar wrapper at the end of a cigar prior to smoking;

elongated member longitudinally aligned within said hollow body and extending from said hollow body first end for piercing a hole in said cigar wrapper at the end of said cigar;

a plunger attached to and movable with said elongated member and movable within said hollow body portion first end along a longitudinal axis thereof toward and away from said cutting edge, said plunger being biased within said hollow body portion away from said first end;

a handle accessible from the exterior of said housing for moving said plunger within said hollow body portion first end; and a spring in said housing for biasing said handle and plunger away from said first end, wherein, in a single operation, said pointed end is adaptable to pierce a hole in the end of a cigar and said cutting edge is adaptable to cut a portion of a cigar wrapper at the end of a cigar to create a plug of the cut portion of the cigar, which plug remains at least in part within said hollow body portion first end and impaled upon said elongated member, and wherein said handle is operable to move said plunger toward said cutting edge to eject said plug from said housing and, upon release of said handle, said spring is adapted to withdraw said plunger away from said cutting edge.

7. The apparatus of claim 1 further includes a spring in said housing for biasing said plunger within said hollow body portion away from said first end.

8. The apparatus of claim 6 wherein said handle extends from the said second end of said hollow body portion, and wherein said handle is operable by pushing said handle toward said first end to eject said plug.

9. The apparatus of claim 6 wherein said handle extends from the second end of said hollow body portion and further including a shaft between said handle and said plunger within said hollow body portion, whereby said handle is operable by pushing said handle toward said first end to eject said plug.

10. A method of piecing and cutting a plug from the end of a cigar comprising the steps of:

a) providing a device comprising a housing having a hollow body portion with opposite first and second ends, the first end of said hollow body portion having a cutting edge for cutting a portion of a cigar wrapper at the end of a cigar prior to smoking; an elongated member longitudinally aligned within said hollow body and extending from said hollow body first end for piercing a hole in said cigar wrapper at the end of said cigar; a plunger attached to said elongated member and moveable within said hollow body portion first end along a longitudinal axis thereof toward and away from said cutting edge and a spring in said housing for biasing said plunger away from said first end;

b) positioning said device such that said elongated member and said cutting edge are adjacent to an end portion of a cigar having a wrapper thereon;

c) moving said elongated member and said cutting edge toward said cigar to pierce a hole in and cut said wrapper and create a plug of the cut portion of the cigar, which plug remains at least in part within said hollow body portion first end; and d) moving said plunger toward said cutting edge to eject said plug from said housing; and e) after ejecting said plug, releasing said plunger to permit said spring to withdraw said plunger away from said first end.

11. The method of claim 10 wherein said plunger is biased within said hollow body portion away from said first end, and including the step of moving said plunger away from said first end after ejecting said plug.

12. The method of claim 10 further including a handle accessible from the exterior of said housing for moving said plunger within said hollow body portion first end, said handle extending from the second end of said hollow body portion, and including the step of pushing said handle toward said first end to eject said plug.

13. A method of piercing and cutting a plug from the end of a cigar comprising the steps of:

a) providing a device comprising a housing having a hollow body portion with opposite first and second ends, the first end of said hollow body portion having a cutting edge for cutting a portion of a cigar wrapper at the end of a cigar prior to smoking; a plunger movable within said hollow body portion first end along a longitudinal axis thereof toward and away from said cutting edge and a spring in said housing for biasing said plunger away from said first end;

b) positioning said device such that said cutting edge is adjacent to an end portion of a cigar having a wrapper thereon;

c) moving said cutting edge toward said cigar to cut said wrapper and create a plug of the cut portion of the cigar, which plug remains at least in part within said hollow body portion first end;

d) piercing a hole in said cigar wrapper using an elongated, solid, longitudinally aligned member shaft within said hollow body and extending from said hollow body first end, such that said elongated member shaft is attached to and movable with said plunger, and wherein said piercing operation is simultaneous with said cutting operation;

e) moving said plunger toward said cutting edge by compressing said spring from an initial position to eject said plug from said housing; and, f) returning said plunger by allowing said spring to expand back to said initial position.

* * * * *

UNITED STATES PATENT AND TRADEMARK OFFICE

CERTIFICATE OF CORRECTION

PATENT NO. : 5,862,808

DATED : Jan. 26, 1999

INVENTOR(S) : Albarello

It is certified that error appears in the above-identified patent and that said Letters Patent is hereby corrected as shown below:

In column 4, line 32, claim 1 after "to" delete "the"

In column 4, line 41, claim 2 after "portion" delete "a way" and substitute therefor --away--

In column 4, line 61, claim 6 before "elongated" insert --an--

Signed and Sealed this

Twenty-fifth Day of May, 1999

*Attest:*

Q. TODD DICKINSON

*Attesting Officer*

*Acting Commissioner of Patents and Trademarks*